US005863282A

United States Patent [19]

Moossun

[11] Patent Number: 5,863,282

[45] Date of Patent: Jan. 26, 1999

[54] THERAPEUTIC AND ORTHOPEDIC LEG REST SYSTEM FOR DESKS

[75] Inventor: Mohamed Hassen Moossun, Dearborn, Mich.

[73] Assignee: Soraya F. Moossun, Dearborn, Mich.; a part interest

[21] Appl. No.: 782,092

[22] Filed: Jan. 13, 1997

[51] Int. Cl.[6] ..... A63B 23/10; A47C 7/50

[52] U.S. Cl. ..... 482/148; 482/904; 482/79; 312/194; 312/195; 297/423.1

[58] Field of Search ..... 312/194, 195, 312/237, 239; 108/107, 108, 144, 50; 297/423.38, 423.26; 482/79, 148, 904

[56] References Cited

U.S. PATENT DOCUMENTS

| | | | |
|---|---|---|---|
| 409,884 | 8/1889 | Towle | 297/423.38 X |
| 1,236,517 | 8/1917 | Benham | 297/423.38 X |
| 1,975,004 | 9/1934 | Jenkins | 312/195 |
| 2,644,688 | 7/1953 | Roberge | 482/148 |
| 3,770,334 | 11/1973 | Weber | 312/194 |
| 3,961,822 | 6/1976 | Daniel | 312/194 X |

FOREIGN PATENT DOCUMENTS

| | | | |
|---|---|---|---|
| 663605 | 12/1951 | United Kingdom | 312/194 |

*Primary Examiner*—Richard J. Apley
*Assistant Examiner*—William La Marca
*Attorney, Agent, or Firm*—Low and Low

[57] ABSTRACT

A unique, simple, and effective leg rest system of great versatility for desks, wherein a hinged or retractable panel is disposed within the leg opening of any desk, and is shifted from an inactive out-of-the-way position to an active position which may be parallel to the floor or at an angle thereto as desired, thereby to permit the desk user to elevate and rest his or her legs, feet, and thighs in comfort as well as to achieve desired orthopedic or therapeutic purposes. Various forms of the invention are disclosed.

7 Claims, 1 Drawing Sheet

THERAPEUTIC AND ORTHOPEDIC LEG REST SYSTEM FOR DESKS

BACKGROUND OF THE INVENTION

In the course of an extended time while seated at a work desk as is common in office operations for executives, managers, clerical staff and others, as well as at home engaged in work, computer, or other activities, the human body and especially the legs, trunk, and back, can become weary, cramped, or even swollen and generally uncomfortable in the usual sitting position with feet on the floor despite efforts in the course of a day to shift position slightly or occasionally to walk away from one's desk.

Indeed, the usual sitting posture at a desk with knees bent and feet generally flat on the floor is not a natural posture or neutral to adverse effect on the body. With time, blood tends to pool in the legs and feet, causing swelling, and even the serious possibility of blood clots. Elevation of the lower limb members can alleviate this condition.

Further, while not as common in the United States, it is customary in many European and South American populations to deliberately take a rest period between noon and two P.M., commonly known as a siesta or sieste. When in an office environment seated at a conventional desk, such a rest is not feasible, and one must leave the desk and go elsewhere.

In passing, it should be observed that a relative lack of sleep is pervasive in our society, and that men and women of all ages frequently complain that "they are always tired". The ability, when work permits, of achieving even a short rest or nap at one's desk serves to alleviate this problem.

Heretofore, notwithstanding the plethora of desk constructions available on the market over many years, whether single pedestal, double pedestal, table-like or with computer credenza arrangements or the like, there has been no ready means to comfortably rest or stretch the legs, or to relatively elevate the same to rest the legs, nap, or to reduce possible swelling while remaining at the desk for protracted periods without leaving.

It is known to provide a mere footrest, per se, adjacent the bottom of a front panel or modesty panel of a desk, but such only elevates the feet a few inches from the floor if at all, and does not materially alter the depending position of the lower limbs and feet. Such rests do not contemplate increased body and leg comfort or indeed, if needed, napping while at the desk.

SUMMARY OF THE INVENTION

The improved leg rest system of the invention is readily provided on or adapted to any desk to provide healthful comfort to the legs, trunk and back whenever desired by the person at the desk. As a further feature, the desk chair may also be provided with leg support means to assist in this regard.

In a preferred basic form, the unique leg rest of the invention comprises a generally rectangular rest panel member extending substantially the full width of the leg opening of the desk. The panel has a length as desired, but at least 12" and preferably more. The panel is pivotally secured about a horizontal axis, as by hinges, to the front panel of the desk on the inside thereof at the top edge of the rest panel. The pivot is spaced below the underside of the desk at the leg opening by a convenient and comfortable distance, as 12" or so.

As such, the panel may be swung upwardly about the pivot when desired, as by grasping its lower edge, to, preferably, a substantially horizontal position generally parallel to the floor. The desk frame on either side of the leg opening, as on the desk pedestals, is provided with latch means to releasably secure the panel in its horizontal position.

When so latched, the rest panel provides a convenient and unobtrusive means for receiving one's legs and calves when extended substantially straight out from the chair or seat at the desk. In this manner, the legs and feet are comfortably elevated to a level generally on a horizontal line with the seat at the desk or the trunk of the user for relaxation and rest, as well as for healthful therapeutic purposes when conditions might otherwise encourage swelling of the feet, ankles, or legs in their normal downwardly extending position while seated at the desk.

The latch means, which may be a simple spring latch, for example, may be readily released when desired to permit the leg rest panel to swing back downwardly to its out of the way position lying vertically as against the inside of the desk modesty panel. If desired, latch means may be provided to hold the rest panel in its lowered inactive position to avoid unnecessary free swinging movement thereof as when bodily moving the desk, for example.

The invention contemplates other and additional structural forms to achieve the desired result to the benefit of the user. Thus, while the pivot point is generally preferred at or near the level of the seat so as to provide a horizontal leg rest substantially coplanar with the desk chair seat, if desired, the hinge zone may be above or below such a position.

With the hinge above the general seat line, the latch means may remain at the seat line, thereby to provide a rearwardly and downwardly inclined leg rest. In like manner, with the hinge line below the general seat level, the leg rest panel latches to provide a forwardly downwardly sloped rest for the calves and feet. There may be a plurality of latch means at differing heights, whereby the user may select a relative level or tilt angle when the panel is generally hinged at a vertical midpoint of the desk front panel.

The leg rest may be in association with a curved contour chair at the desk, thereby to provide in the form providing a rearward and downward inclination of the leg rest a general continuation of the shallow curve of the contour chair, for example.

Further, in lieu of a pivot mounting and a latch device, the desk may be provided with slotted tracks on either side of the leg opening in which the leg rest may slide. In this instance, it is preferred that the leg rest be formed of parallel articulated sections, in the manner of a roll top desk, whereby the rest may be guided toward the user in a curved path to provide ready storage of the rest as before at the front of the desk generally adjacent the modesty panel.

While a newly manufactured desk may have the leg rest system of the invention built into it, the invention readily lends itself to aftermarket adaptation for attachment to and use with existing desks.

BRIEF DESCRIPTION OF THE DRAWINGS

The invention will be better understood in connection with the accompanying drawings, in which.

DESCRIPTION OF THE PREFERRED EMBODIMENT

Figure 1:
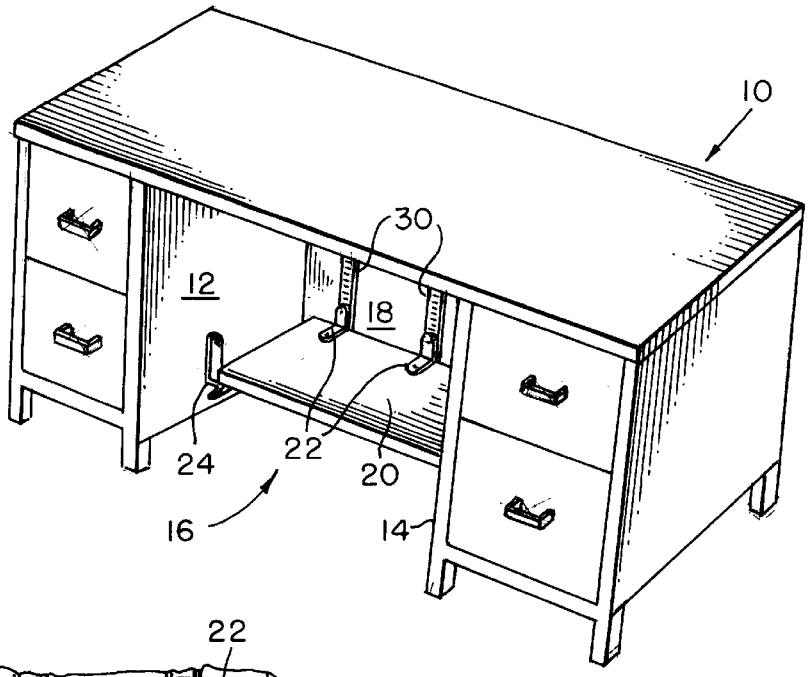
FIG. 1 a perspective view of an illustrative desk having the leg rest of my invention.
Figure 2:
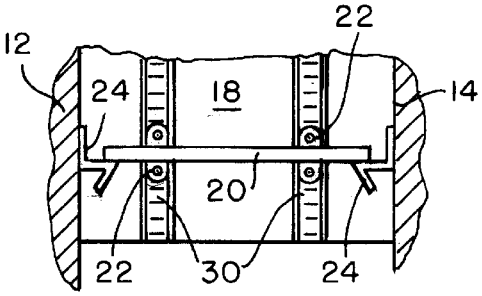
FIG. 2. is a fragmentary front elevation of the leg opening of the desk of FIG. 2 showing the leg rest.

In FIG. 1 there is shown a typical and illustrative desk 10 of the two pedestal type incorporating the leg rest of my invention. The desk as shown includes right and left pedestals having interior walls 12, 14 on either side of the central leg opening 16, and a usual modesty panel 18 at the front of the leg opening 16.

A leg rest, as a rigid panel 20, is pivotally secured to the desk modesty panel 18 by hinges 22 to permitting swinging movement of the leg rest panel 20 preferably through substantially 180° from an inactive nonuse position hanging or depending downwardly from the hinges substantially parallel to the modesty panel 18 to a generally horizontal position as seen in FIG. 1, for example. Other possible leg rest positions will be noted hereinafter.

While a spaced pair of hinges 22 are shown in FIG. 1, the form of hinge is not critical to the invention, and may be of any well known construction, as a full length or partial length piano hinge, or three or more hinges, as may be desired or found aesthetically appealing.

The leg rest 20 is preferably maintained in its use position by latch means 24 secured to the interior pedestal panels 12, 14. As illustrated, the latch is a simple spring latch of spring metal or plastic, whereby the same may be flexed away to permit upward swinging movement of the panel 20 initially past the latch, and then seated upon an inwardly extending portion of the latch 24. The latch may be flexed outwardly to release the panel and permit the same to pivot back downwardly to the inactive position against modesty panel 18 when desired.

Again, the latch means shown is illustrative only, and any desired latch means may be employed, a spring ball detent means, pivoted dogs, etc. or any other construction equally well known in the art.

Figure 4:
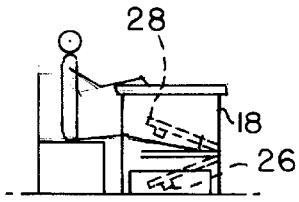
FIG. 4 is a diagrammatic illustration of the hinge position leg rest form of FIG. 1 and showing its relative position to a person at the desk.

When the leg rest panel has been snapped past the spring latch and seated, as in FIG. 1, the user of the desk may then rest his legs and calves upon the panel as seen in FIG. 4, for example. In so doing, the legs are elevated from the floor, the leg and thigh muscles are shifted and extended in a manner quite different from that of the conventional seated position, all to beneficial physical and mental effect on the person seated at the desk.

The desk chair, while an independent member, forms an important and cooperative relationship with the leg rest. It is preferred that the desk chair have both an adjustable or reclinable back and a vertically adjustable seat, whereby in cooperation with the leg rest it becomes possible to provide an extended or stretched out body position for the desk user for greater rest, or even quick napping, with maximum comfort to the user and thereby able to accommodate height differences.

Obviously, especially in the case of persons inclined toward or having nether limb circulatory problems, the ability to shift the position of one's legs and feet during extending desk presence also constitutes a considerable easing or reduction of possible pain or discomfort.

While in the preferred and perhaps most useful form of the invention as seen in FIG. 1, the leg rest 20 is substantially horizontal, additional sets of latch means 24 may also be provided on the desk both above and below the generally horizontal location shown. The same are illustrated in phantom lines in FIG. 4 as including a lower latch pair 28 and an upper latch pair 26. In so doing, the leg rest 20 may be positioned in an upwardly and rearwardly inclined position on latches 28 and in a downwardly and rearwardly inclined position on latched 26.

Such a variety of positions enables the user to select those which may be most comfortable of beneficial to the user, or even as needed for orthopedic and therapeutic purposes as may be suggested or required by the user's medical practitioner.

In this regard, again, it is not uncommon for the user to have, or have available, a desk chair whose seat is adjustable and therefore capable of varying height above the floor. The use of such a chair in connection with the differing positions of the leg rest provide a maximum versatility and user benefit to achieve the most comfortable or healthful possible position at any time.

In the simplest and preferred embodiment of the invention, as shown, the leg rest is hinged essentially at a midpoint in height of the desk modesty panel 18 corresponding to the usual height of a desk chair. In a further form and concept of my invention, the hinge means 22 may be variably located vertically along the modesty panel 18, thereby to position the hinge as desired to permit the panel to partake of desired locations.

Figure 3:
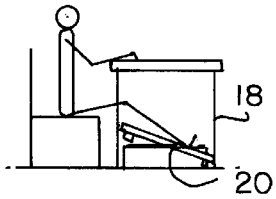
FIG. 3 is a diagrammatic illustration of the leg rest as inclined upwardly and rearwardly from a lower hinge position and showing its relative position to a person at the desk.
Figure 5:
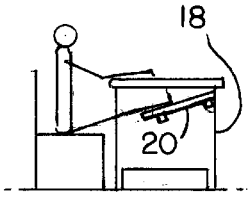
FIG. 5 is a diagrammatic illustration of the leg rest as inclined downwardly and rearwardly from an upper hinge position and showing its relative position to a person at the desk.

The hinges, as at 22 in FIG. 1, according are mounted to be slidable along a track, as the pair of vertical tracks 30 mounted on the modesty panel 18, and may be positioned and locked by conventional and known clamp means at any desired height. Thus, in the form of FIG. 3, the panel hinges are at a lower position with the panel inclined upwardly and rearwardly as shown to permit leg rest with the knees only slightly bent. In FIG. 5, similarly, the hinge means is positioned at an upper point to even further elevate the legs as may be desired.

Figure 6:
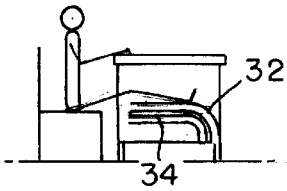
FIG. 6 is a diagrammatic illustration of a further modification wherein the leg rest is articulated and received within side guides on the desk; and, FIG. 7 is a diagrammatic front illustration of the modification of FIG. 6.
Figure 7:
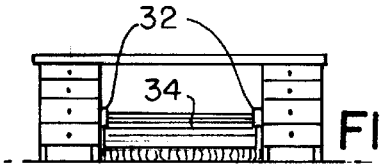

FIG. 6 shows a modified form of the invention wherein in lieu of the latch means on the pedestal interior walls, a pair of arcuate guides 32 is provided on either side in which a modified leg rest 34 is slidably disposed. The modified leg rest 34 is formed from a series of transverse articulated slats in the nature of a cover for a roll top desk. Accordingly the same may be pulled upwardly to the use position shown, and then may be pushed rearwardly and downwardly to rest position to reopen the leg opening of the desk. This form of the invention while attractive and useful, is less versatile than the preferred forms discussed above. A variant on the above modification is the provision of an inherently curved or rolled up fabric or plastic web secured at one end to an axle rotatably attached to the rest mount and having a transverse pin secured to the other end of the web in the manner of a window shade. The ends of the pin lie in the opposed guides or tracks 32 whereby as the pin is pulled down, the web unrolls, and the pin can be detachably latched in the unrolled position to rest the legs.

Additionally, while to facilitate understanding of the invention, the leg rest has been shown as a simple panel, it is within the scope of the invention to include cushioning or a mat in association therewith. Likewise, heating means, or massaging and vibrating devices may be incorporated in the rest for beneficial effect on the user.

In the several embodiments, the leg rest is set forth for simplicity and minimum cost of fabrication as manually placed into use or rest position. It is within the scope of the invention to provide power means, as a small motor, having a reversing switch at the desk and wherein the motor is affixed to the desk and through conventional linkage attached to the rest may swing the rest down for use, and thence retract the same upwardly when desired.

The invention has been disclosed in connection with a typical two pedestal desk 10. The same is obviously adapted for use with a single pedestal desk wherein a latch means may be associated with a free-standing leg on the non-pedestal side of the desk. In like manner, should a desk not have a conventional modesty panel, the tracks 30 carrying the leg rest hinges may be mounted to the top of the desk at the front thereof and depend therefrom. Other variants suggest themselves within the scope of the invention.

What I claim is:

1. A leg rest for desks having a rearwardly facing leg opening and a desk front portion forwardly thereof, comprising, a generally planar leg rest panel having opposed front and rear edges, a hinge for pivotally connecting said leg rest panel to the front portion of the desk adjacent the leg opening of the desk to permit said panel to hang vertically generally downwardly in inactive position and to be swingable upwardly toward the rear of the desk about said hinge within the desk leg opening, said hinge being associated with said front edge of said panel, thereby to permit grasping of said panel rear edge to swing said panel about said hinge, and, a latch device cooperatively associated with the desk within said leg opening thereof and with said panel for releasably retaining said panel in a fixed position other than vertical when swung upwardly about said hinge, thereby providing a foot and leg rest support for the user of the desk elevated above the floor, said latch device including a plurality of latches at vertically spaced positions on said desk on either side of said leg rest panel and generally adjacent the rear edge thereof, thereby to permit selective positioning of said leg rest panel at differing locations for desired leg and foot comfort.

2. The leg and foot rest of claim 1 wherein said panel is in vertically spaced relation to the underside of the desk top when swung to said horizontal position, thereby to provide clearance between the desk top and the panel for the legs and feet.

3. The leg and foot rest of claim 1 wherein said latch device comprises a spring latch.

4. The leg and foot rest of claim 3 wherein said spring latch is secured to a frame portion of the desk generally adjacent the other said edge of said panel.

5. The leg and foot rest of claim 2 wherein said hinge is connected to a modesty panel of said desk at the said front portion of the desk at said leg opening thereof.

6. The leg and foot rest of claim 5 further including generally vertical guidance tracks wherein the tracks are mountable on the modesty panel, said hinge being constructed for sliding movement on said tracks, and a securing device to releasably fix said hinge in a desired position along said tracks to position the leg and foot rest as desired.

7. The leg and foot rest of claim 6 wherein a plurality of said latches are provided at vertically spaced positions on said desk on either side of said leg rest panel, thereby to permit selective positioning of said leg rest panel at differing locations.

* * * * *